US005217694A

United States Patent [19]

Gibler et al.

[11] Patent Number: 5,217,694

[45] Date of Patent: Jun. 8, 1993

[54] HOLDER FOR EVACUATED TEST TUBES

[76] Inventors: W. Brian Gibler, 778 Stonebridge Dr., Cincinnati, Ohio 45233; Ellen K. Gibler, 1003 Stream Ridge La., Cincinnati, Ohio 45255; Susan H. Gibler, 5679 N. Washington Blvd., Indianapolis, Ind. 46220

[21] Appl. No.: 857,465

[22] Filed: Mar. 25, 1992

[51] Int. Cl.[5] ..... A47F 7/00

[52] U.S. Cl. ..... 422/104; 422/99; 422/65; 211/74

[58] Field of Search ..... 422/104, 65, 99, 63; 248/146, 311.2; 211/74; 221/123, 279; 141/130, 132

[56] References Cited

U.S. PATENT DOCUMENTS

| | | | |
|---|---|---|---|
| 2,725,782 | 8/1952 | Worley | 211/74 |
| 3,625,397 | 12/1971 | Shelly | 221/279 |
| 3,768,526 | 10/1973 | Sanz et al. | 422/63 |
| 3,832,140 | 8/1974 | Lorch et al. | 141/130 |
| 4,310,097 | 1/1982 | Merl | 211/74 |
| 4,401,221 | 8/1983 | Suttles | 211/74 |
| 4,861,553 | 8/1989 | Mawhirt et al. | 422/104 |
| 4,982,850 | 1/1991 | Mears | 211/74 |

OTHER PUBLICATIONS

Baxter Catalog 1991-92, Vacu-Rack, p. 1832 Baxter Diagnostics Inc., Ill.

*Primary Examiner*—James C. Housel
*Assistant Examiner*—Ramon Torres
*Attorney, Agent, or Firm*—Wood, Herron & Evans

[57] ABSTRACT

A holder for evacuated test tubes used for blood or bodily fluids having rubber stoppers includes a case having a plurality of channels. The test tubes ride in channels supporting themselves or supported by the flanges of the rubber stoppers. A spring or other mechanism to push or pull the test tubes forwardly along the channels to a forwardmost position is used. At the forwardmost position a separate flap is present which includes a hole aligned with each of the rubber stoppers in the test tubes in this forwardmost position. Thus, when blood or other bodily fluids are transferred from a hypodermic needle-tipped syringe, the needle is pushed through the hole in the flap directly into the rubber stopper of the test tube. When the fluid is transferred, the needle is removed, and the flap can be lifted to remove the test tube which can then be sent to the testing lab.

11 Claims, 5 Drawing Sheets

HOLDER FOR EVACUATED TEST TUBES

BACKGROUND OF THE INVENTION

The diagnosis of disease in medical practice requires testing of bodily fluids, particularly blood. In physician offices, laboratories, and in the hospital setting, blood and other bodily fluids are aspirated from the individual patient using a syringe with an attached hypodermic needle. The hypodermic needle, with blood or bodily fluid contained in the attached syringe, is then inserted through a rubber stopper into an evacuated test tube. The fluid is drawn immediately into the tube from the syringe, through the hypodermic needle.

The health care worker who introduces the syringe/hypodermic needle combination into the test tube, typically holds the test tube in one hand while attempting to insert the needle with his or her other hand. This creates an inherent risk of being stuck with the contaminated needle and being infected with various diseases, in particular Acquired Immune Deficiency Syndrome (AIDS) and hepatitis, both of which can cause debilitation and death. This may be avoided by providing a shield between the hand and the needle.

An example of such a system is disclosed in Mears U.S. Pat. No. 4,982,850. This patent discloses a hand-held holder for a plurality of tubes. The tubes are inserted for each use by the health care worker into receptacles which form a shield protecting the health care worker's hand while the syringe/needle is inserted into the test tube. This system is cumbersome in that it requires that the device be located, manually loaded with test tubes for each use, and then used in quite hectic situations such as major resuscitations of a trauma victim in the hospital emergency department.

In this chaotic environment, the health care worker is at greatest risk for contaminated needle sticks. Likewise, in this situation, the health care worker will be least likely to provide for his or her own safety. Use of a manual shield requires additional actions (as noted above) which decrease time available to care for the patient. Such use of a hand-held device is also inconvenient, potentially limiting its use by the health care worker in non-life threatening scenarios as well.

SUMMARY OF THE INVENTION

Accordingly, it is an object of the present invention to provide a device which allows a plurality of test tubes of varied sizes to be automatically fed to an insertion point where the health care worker can insert and remove a hypodermic needle-tipped syringe without holding the test tube by hand. Transfer of blood and bodily fluids from a hypodermic needle-tipped syringe to the evacuated tube, using only one hand holding the syringe will minimize contaminated needle sticks for the health care worker.

Further, it is an object of the present invention to provide such a device which by automatically advancing test tubes makes it easier for the health care worker to follow appropriate safety procedures.

These objectives, as well as others, are accomplished by a holder of evacuated test tubes which has a series of channels or raceways adapted to hold a plurality of tubes. The tubes are moved from the back to the front of the device and stop under a front movable flap. The flap has a series of holes aligned with the forwardmost tubes. The needle of a syringe can be inserted and removed through one of these holes, directly through the rubber stopper allowing blood or bodily fluid to flow into the evacuated test tube. Due to the position of the clear glass tubes at the front of the device, easy visibility is provided for the health care worker to distinguish test tubes filled with blood or bodily fluid from unused tubes.

Since many test tubes of a variety of sizes are stored in the holder and fed to an accessible position, the health care worker will find it easy, rapid and safe to insert and remove the needle through the flap into the evacuated test tube. The syringe/hypodermic needle can then be discarded. Once filled with blood or bodily fluid, the health care worker will lift the flap to remove the test tube safely and quickly. This should substantially reduce the likelihood of a self-induced contaminated needle stick for the health care worker. As this device provides storage for a plurality of evacuated test tubes requiring only periodic reloading, health care workers will likely recognize this device as a safe, rapid, and practical method for emptying syringe/hypodermic needles filled with blood and bodily fluids.

It is important to note that this device, containing a plurality of test tubes, can be large and sedentary providing significant storage capability for a large number of test tubes sitting or mounted on a counter shelf in the emergency department, for example. By decreasing the size of the device, the unit would hold a smaller number of a plurality of test tube sizes, lending itself to portability. This device could then be carried easily by a phlebotomist while drawing blood throughout a hospital.

In conclusion, this device provides a system which is a safe, rapid, and effective method to provide test tubes for health care workers in which to place blood and bodily fluid samples. Ease of use of this device will allow one-handed dispensing of blood and bodily fluids into evacuated test tubes. This device will decrease the likelihood of contaminated needle sticks for the health care worker by eliminating the use of the non-dominant hand for holding the test tube during insertion and removal of the syringe/hypodermic needle containing blood or bodily fluids. These advantages and others will be further appreciated in light of the following detailed descriptions and drawings in which:

DETAILED DESCRIPTION

Figure 1:
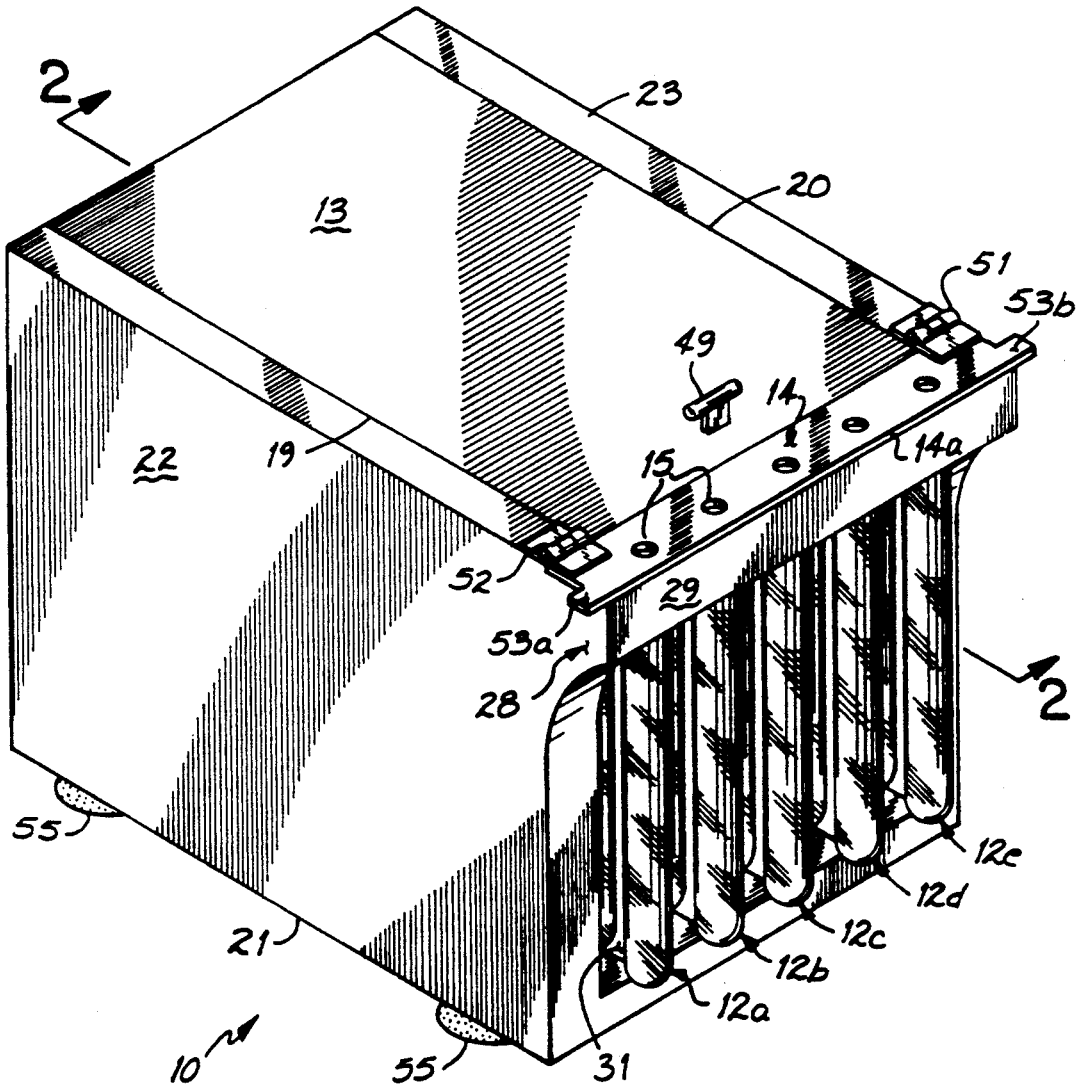
FIG. 1 is a perspective view of the present invention.
Figure 3:
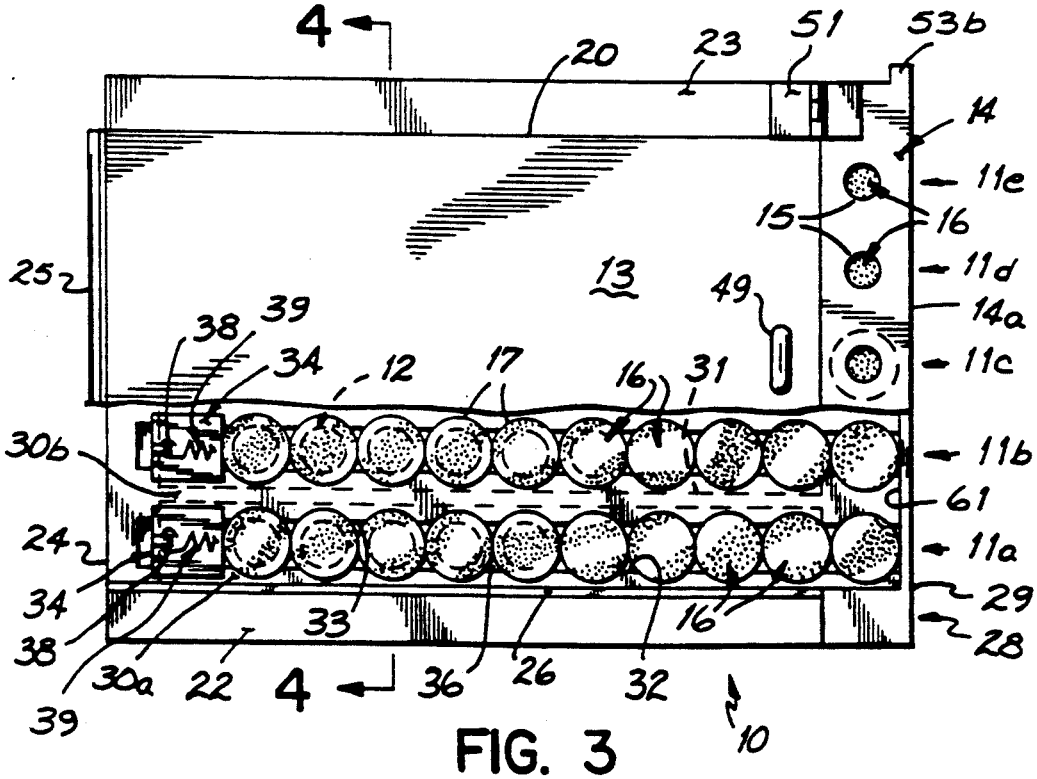
FIG. 3 is an overhead view of FIG. 1 partially broken away.

As shown in FIGS. 1 and 3, the present invention is a test tube holder 10 which supports a plurality of rows 11*a*, 11*b*, 11*c*, 11*d*, and 11*e* of test tubes 12. The holder includes a top 13 which covers the rows 11 of test tubes 12 and a front flap 14 which covers the forwardmost test tubes 12*a*, 12*b*, 12*c*, 12*d* and 12*e* in each of these rows. The flap includes a plurality of holes 15 which are designed to register immediately above the rubber stopper 16 of the forwardmost test tubes 12*a*–12*e* in each of rows 11.

Figure 2:
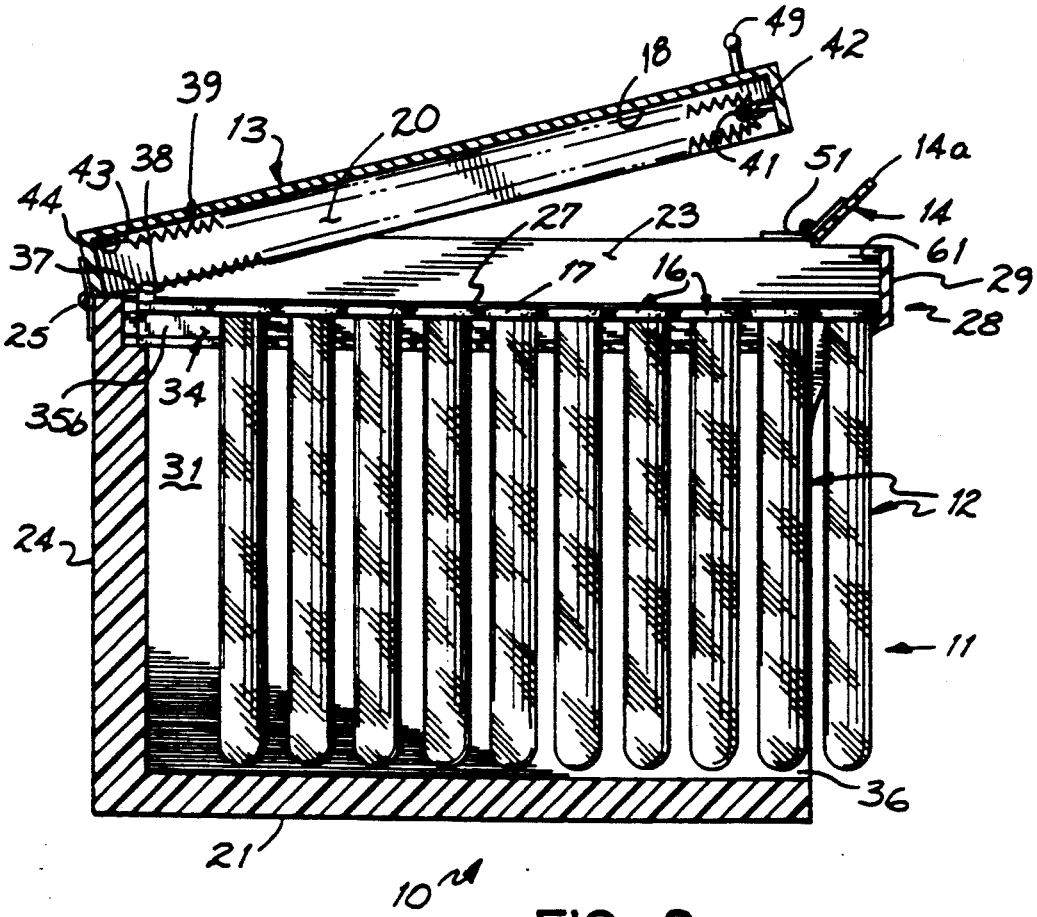
FIG. 2 is a cross sectional view taken at lines 2—2 of FIG. 1.

More particularly, in FIGS. 1 and 2, the test tube holder 10 includes a bottom 21, first side 22 and second side 23. Extending between sides 22 and 23 is the back wall 24. Top 13 extends from the back wall 24 to the back edge of flap 14. Flap 14 covers the forwardmost portion or cantilevered portion 28 of the holder 10. The forward edge 14*a* of flap 14 is even with forwardmost edge 29 of holder 10.

Figure 4:
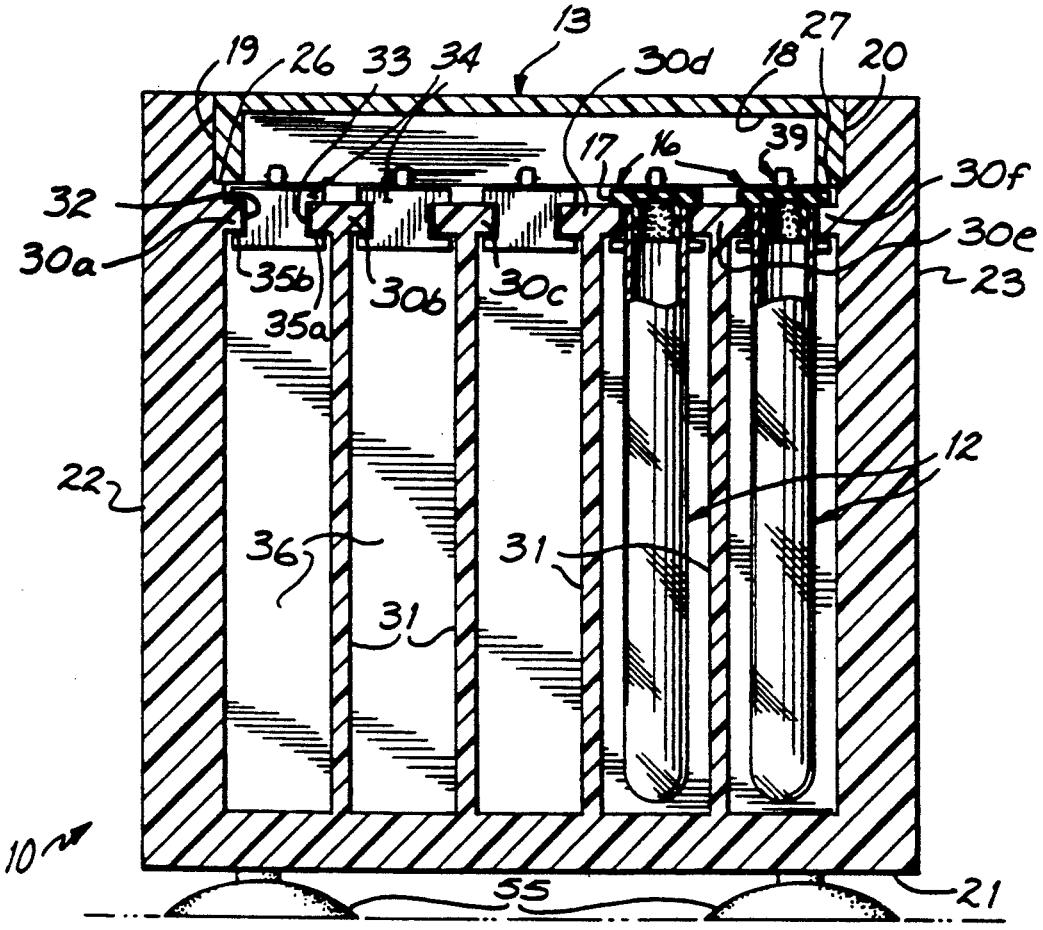
FIG. 4 is a cross sectional view taken at lines 4—4 of FIG. 3.
Figure 5:
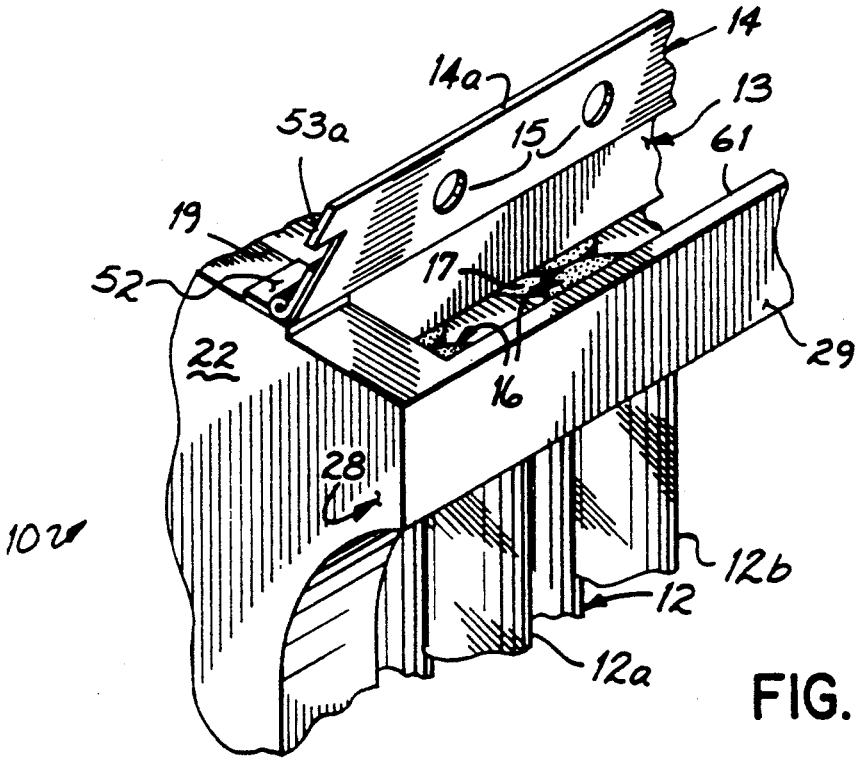
FIG. 5 is a corner perspective view broken away.

Inside the test tube holder 10 (FIGS. 3 and 4) are a plurality of adjacent parallel strips 30 which extend from the back wall 24 to the cantilevered portion 28. The first strip 30*a* and last strip 30*f* are supported by sides 22 and 23, respectively. Each additional strip 30*b*, 30*c*, 30*d* and 30*e* are supported by vertical panels 31 (shown in dashed lines in FIG. 3) which run from the back 24 to the front portion 28 of holder 10 and form channels 36.

The gap between edges 32 and 33 of adjacent strips 30 is wide enough to allow the body 12*a* of a test tube to slide between the edges 32 and 33, but is narrow enough to catch the flange portion 17 of rubber stopper 16. Thus, the test tubes 12 are supported by adjacent edges 32 and 33 of these strips such as 30*a* and 30*b*.

A pusher 34 (FIGS. 2, 3 & 4) includes right and left channels 35*a* and 35*b* which ride along adjacent edges 32 and 33. There is one pusher 34 in each of the gaps between adjacent strips. The pusher 34 includes an eyelet 37 connected to the first end 38 of a spring 39. The spring 39 extends forwardly and passes around a bearing 41 which is held to the underside 18 of top 13 by a U-clip 42. The second end 43 of spring 39 then engages a second eyelet 44 which is fixed to the underside 18 of top 13. This keeps the spring 39 in tension pulling pusher 34 from the back side 24 towards the cantilevered front portion 28 of holder 10.

The top 13 is connected to the back wall 24, by hinge 25. The hinge 25 connects the back portion of top 13 to the back wall 24 permitting it to pivot at this point. The side edges 19 and 20 of top 13 will ultimately rest in ledges 26 and 27 of sides 22 and 23 which support the top high enough above the rubber stoppers of the test tubes to provide clearance for the springs 39 allowing the test tubes to slide in the channel 36.

Flap 14 which covers the cantilevered portion 28, is attached to the side walls 22 and 23 by hinges 51 and 52. These can be spring-biased hinges to force the flap 14 down. Lateral tabs 53*a* and 53*b* permit the flap to be raised.

As shown in FIG. 3, the edges 32 and 33 of the strips 30 extend all the way up to a cantilevered portion 28 to upstanding portion 61 which acts as a stop. Vertical walls 61 stop the forward progress of the test tubes and aligns them with the holes 15 in the flap 14.

Finally, the entire holder 10 is supported by four suction cups 55 secured to the bottom 21. These maintain the holder in position preventing the device from sliding on a table, etc.

The holder can be formed from various materials, including metal, plastic coated wire, or molded plastic. The ability to safely autoclave the device may be necessary in some work environments.

To use the test tube holder 10 of the present invention, the top 13 is lifted up by handle 49. This will cause the springs 39 to pull back on pushers 34 exposing the channels 36. Test tubes 12 with rubber stoppers will be positioned in these channels and the flange 17 of each rubber stopper 16 will support or guide the test tubes 12 between edges 32 and 33 of adjacent strips 30. The top is then lowered so that its sides rest in ledges 26 and 27 of side walls 22 and 23. This will cause springs 39 to draw the pushers 34 and test tubes 12 towards the front portion 28 of holder 10. The forwardmost test tubes 12*a*–12*e* in each row will engage the stop portions 61. This will cause the rubber stopper 16 of these forwardmost test tubes to reside immediately below the holes or access openings 15 in the front flap 14.

Thus, when a blood sample is taken from a patient using a hypodermic needle-tipped syringe (not shown), it is inserted using one hand through the hole 15 and through a rubber stopper 16 into one or many of these forwardmost test tubes 12*a*–12*e* and then removed to be discarded. The vacuum in the test tubes will then pull the blood from the hypodermic needle-tipped syringe into the test tube. All of the forwardmost test tubes 12*a*–12*e* can be filled simultaneously or sequentially. Once these are filled, the flap 14 is raised up by pulling on either tab 53*a* or 53*b* and the test tubes pulled directly up from the holder 10. Once one of these forwardmost test tubes is removed, the next test tube in that particular row will be moved forwardly to the stop portion 61, again in alignment with the hole 15. Periodically the top 13 can be raised and additional test tubes inserted into the holder as required. Because the forwardmost tubes are visible from the front of the holder, the medical personnel can see which tubes have been used and which ones are available for use.

As can be seen from the description, the easiest way to transfer blood or bodily fluid from a hypodermic needle to one of these test tubes is by the proper use of the proposed invention. The easiest way for the health care worker to transfer fluid from a hypodermic needle-tipped syringe is by inserting the needle through the hole 15 into the test tube, with subsequent removal of the needle, using one hand. This virtually eliminates the possibility of sticking oneself with the needle while inserting it into a hand held test tube.

Since this device can hold test tubes of a plurality of sizes, virtually any laboratory test of blood or bodily fluid can be accommodated. Because unused test tubes are immediately advanced when a test tube is removed from this device, repeated use of this holder by the health care worker is facilitated. As the leading test tube position in each row is depleted, it is obvious that additional test tubes must be added. A clear top 13 for the holder would also clearly indicate when the device required refill.

Figure 6:
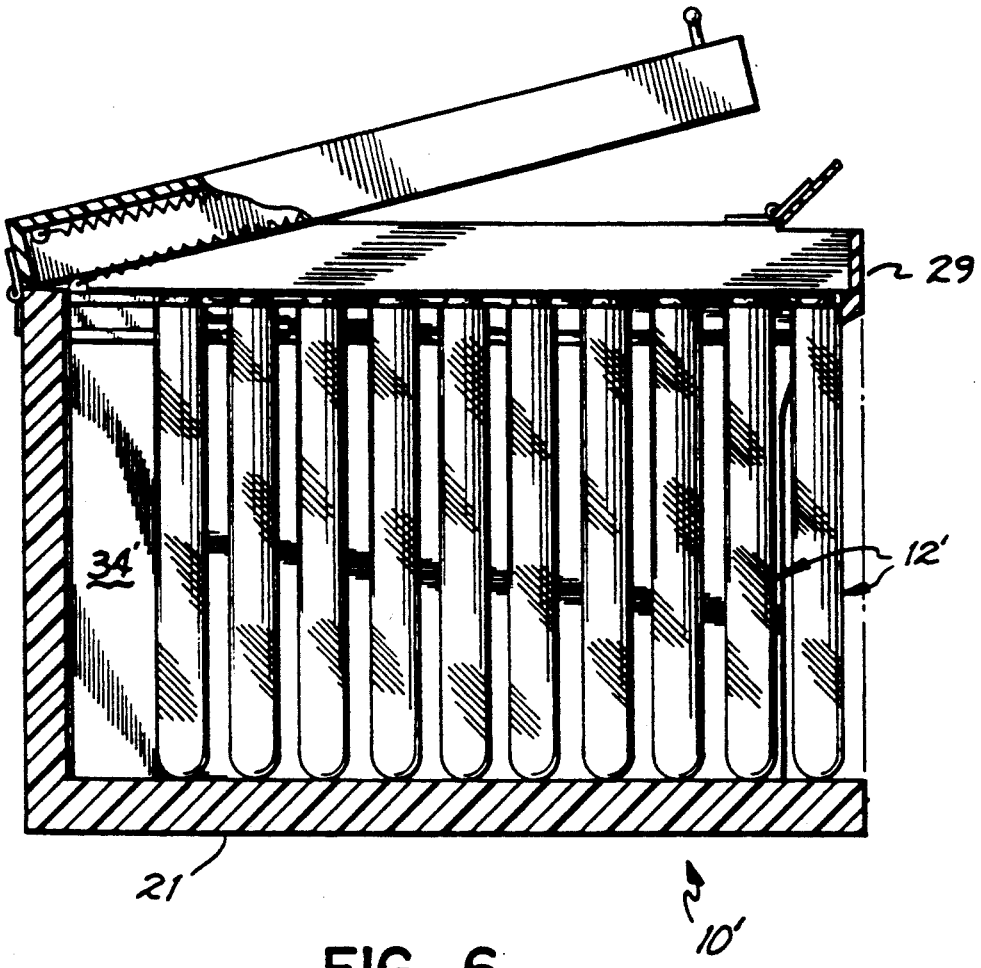
FIG. 6 is a cross sectional view of an alternate embodiment of the present invention.

A first alternative embodiment of the present invention is shown in FIG. 6. This embodiment is designed to hold test tubes which have the same diameter as the stopper, i.e., there is no peripheral flange. In this embodiment, the test tube holder 10' is sized to provide support for the test tubes 12' using the bottom wall 21. As shown in this embodiment, the bottom wall extends all the way to the forwardmost portion 29 of the holder. The pusher 34', in turn, extends the entire height of the holder to push along the entire length of the test tube, preventing them from tilting as the top portion is pushed forward. Pusher 34' in FIG. 6 is shown in rearwardmost or relaxed position with the row of test tubes not yet compressed together.

Further in this embodiment and in the preferred embodiment, a pusher is used to move the tubes forward. This is simply one means to move the tubes to the forwardmost position. In lieu of a spring-biased pusher, pneumatics could be used as well as an electric drive. These devices may be preferred in some situations.

As shown, the preferred device is supported simply by suction cups. Of course, this could be supported by a number of methods or even carried around the hospital by a phlebotomist. This could be incorporated into a case, or incorporated directly into cabinetry, or even into a movable cart.

Figure 7:
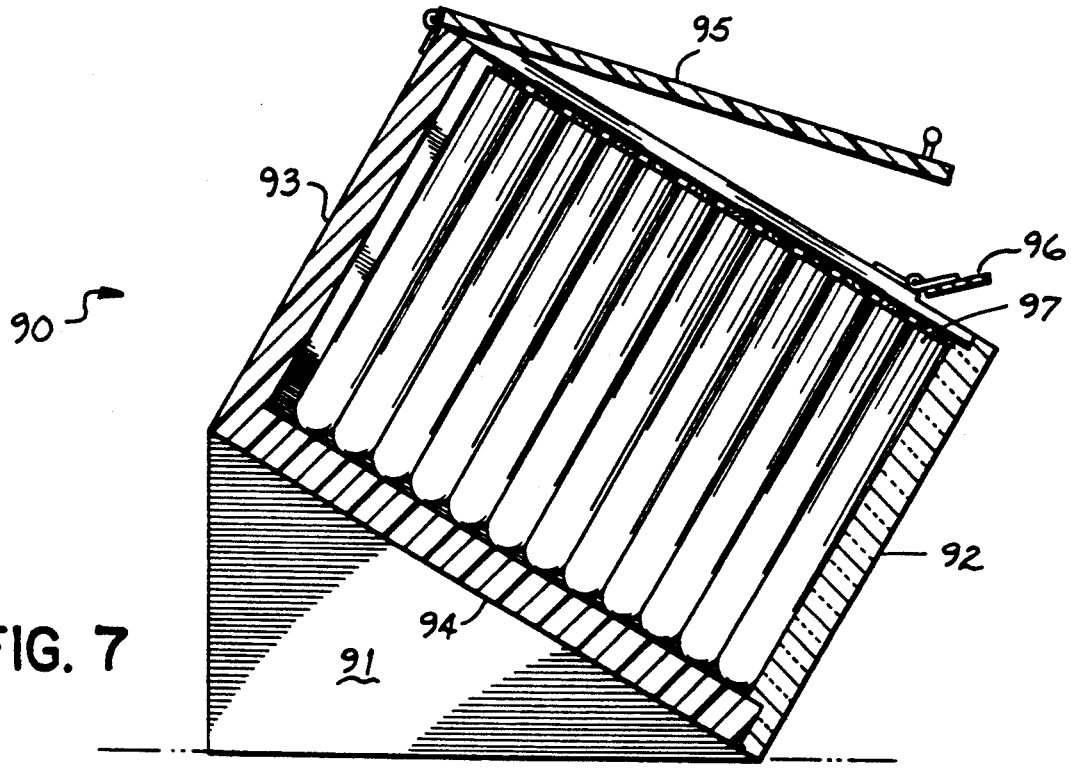
FIG. 7 is a cross-sectional view of a second alternate embodiment of the present invention.
Figure 8:
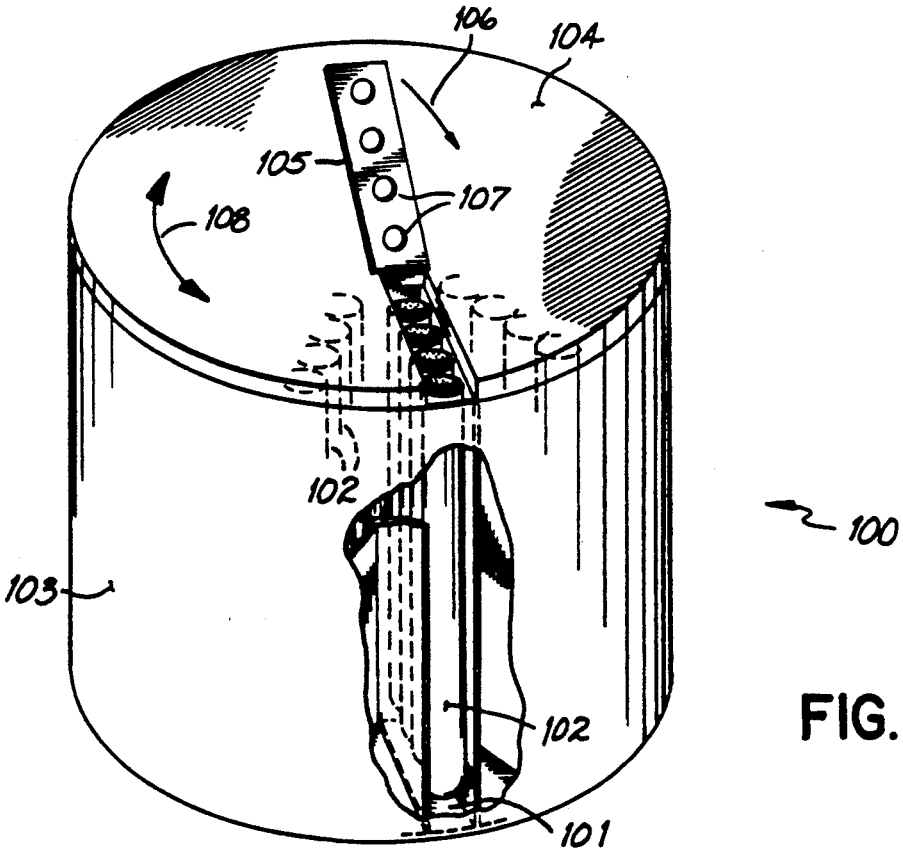
FIG. 8 is a perspective view of a third alternate embodiment of the present invention partially broken away.

FIGS. 7 and 8 show two additional embodiments of the present invention. In FIG. 7, the test tube holder 90 rests on an inclined plane 91. This apparatus also includes a plurality of channels (one shown), front wall 92, back wall 93, and bottom wall 94, along with a hinged top 95. A flap 96 with access holes (not shown) in line with the forwardmost test tubes 97 (one shown) is provided. The front wall 92 is made of a clear plastic material so that one can see if the forwardmost test tubes have been filled. In this embodiment, gravity would force the tubes to the forwardmost or access position against wall 92 beneath the holes in flap 96.

The test tubes would be inserted by opening top 95 and inserting the tubes into the channels. The tubes would be removed after filling by lifting flap 96 and pulling the tubes out of the holder 90.

A third alternate embodiment is shown in FIG. 8 wherein the test tubes 102 are all maintained in a carousel 100. This includes a plurality of channels 101 to receive the test tubes 102. The channels radially extend from a center portion of the carousel. The carousel includes a cylindrical side wall 103 and a circular top lid 104. A flap 105 pivots from the central portion of the top lid 104 and can be lifted up or closed as shown by arrow 106 to provide access to tubes in individual channels. The flap includes holes 107 adapted to register with tubes beneath in channel 101. In this embodiment, the top 104 rotates relative to the side 103 as shown by two-headed arrow 108. Thus, to access tubes, the top 104 is rotated relative to the cylindrical side wall 103 so that the flap 105 is immediately above a channel 101 full of test tubes 102.

The test tubes can be filled by inserting the needle through the respective holes 107 into the test tube. To remove the test tubes from the channel, the flap 105 is lifted and the test tube lifted out. Flap 105 is optional and may be unnecessary in certain applications.

In this embodiment, various ways could be used to rotate the top 104 relative to the side wall 103. The side wall could be stationary while the top wall rotates, or alternately, the side wall could rotate on a lazy susan-type device with the top wall supported by a stationary post supported on a base beneath the lazy susan device. In either event, this provides for storage of multiple tubes and provides a means to access a limited number of tubes to provide for transport of bodily fluids. The flap or opening above the channel provides an access station and movement of the top relative to the bottom provides a method means to advance selected tubes to the access portion and store the remainder.

This description of the present invention is intended to be a description of the best mode currently known to the inventors. This invention lends itself to many minor modifications such as changing materials or pushing mechanisms, incorporating it into a cart or hand held tray, or providing means to mount it to a wall or cabinet.

However, the present invention should only be defined by the appended claims wherein we claim:

1. A holder in combination with evacuated test tubes, said test tubes adapted to receive blood and bodily fluids transferred from a hypodermic needle-tipped syringe wherein said tubes include a test tube portion and a rubber stopper having a radially extended flange;

said holder having at least one channel extending from a front portion to a back portion of said holder and first and second edges alongside said channel, said edges spaced apart to permit said test tubes to slide within the channels and be supported by the radially extended flange of the rubber stopper or the tubes themselves;

means to move said test tubes in said channel from the back of the holder to a forwardmost position of said channel at the front portion;

a flap covering said forwardmost position of said holder, said flap having at least one hole, aligned directly above the rubber stopper of the forwardmost test tube in said channel;

whereby the hypodermic needle-tipped syringe can be inserted and removed from the rubber stopper through said hole directly into a test tube positioned at said forwardmost position, whereby the flap holds the tube in place while the needle is removed.

2. The test tube holder claimed in claim 1 wherein said holder includes a plurality of channels adapted to hold test tubes and a plurality of means to move test tubes riding in said channels to forwardmost positions of each of said channel, at said front portion said flap having a plurality of holes, one each aligned above said forwardmost position of each channel.

3. The holder claimed in claim 1 wherein said means to push said tubes from said back portion to said front portion of said holder comprises a pusher riding in said channel.

4. The holder claimed in claim 3 wherein said holder has a top wall wherein said pusher is urged forwardly by a spring fixed at one end to said pusher and fixed at an opposite end to the top wall.

5. The holder claimed in claim 4 wherein said top wall is hinged to said holder and can be raised to permit insertion of test tubes into said holder.

6. The holder claimed in claim 1 wherein the body of said forwardmost test tube is visible to permit determination if said tube has been filled.

7. The holder claimed in claim 1 wherein said holder comprises a carousel having a plurality of radially extending channels adapted to receive test tubes, a top, said top having a radially extended access opening, means to move said top relative to said channels to position said access opening above any one of said channels.

8. A holder having a plurality of rows of evacuated test tubes, said test tubes having a body portion and a rubber stopper top, said stopper having a flange extending beyond the body portion of said test tubes;

said holder including a front portion, back portion and a top;

a plurality of strips extending from said back portion to said front portion, a plurality of channels between adjacent strips, said channels adapted to support the flange of said rubber stoppers and allow said test tube body portion to slide therein;

a plurality of parallel adjacent pusher elements adapted to ride on adjacent strips in each of said channels and push test tubes forwardly in each of said channels to a stop portion, at a forwardmost position in each of said channels and a flap covering said forwardmost position of said channels, said flap having a plurality of holes one each aligned with each of said channels.

9. A holder for evacuated test tubes adapted to receive blood and bodily fluids transferred from a hypodermic needle-tipped syringe wherein said test tubes include a tube portion and a rubber stopper;

said holder having a plurality of channels extending from a front portion to a back portion of said holder and each channel having first and second edges alongside said channel, said edges spaced apart to permit said test tubes to slide within the channels and be supported within said channels;

means to move said test tubes in said channels from the back portion of the holder to a forwardmost position of said channels at the front portion;

a flap covering said forwardmost position of said channel, said flap having a hole, aligned directly above the rubber stopper of the forwardmost test tube in each of said channels;

wherein said flap is hinged to said holder whereby said flap can be lifted to permit test tubes to be removed form said forwardmost positions;

whereby the hypodermic needle-tipped syringe can be inserted and removed from a rubber stopper through said hole directly into a test tube positioned at said forwardmost position, whereby the flap holds the tube in place while the needle is removed.

10. A holder for evacuated test tubes adapted to receive blood and bodily fluids transferred from a hypodermic needle-tipped syringe wherein said tubes include a tube portion and a rubber stopper;

said holder having means to hold a plurality of test tubes and having an access opening providing access to a limited number of said test tubes;

means to move said stored test tubes relative to said access opening so that additional test tubes can be accessed through said access opening;

whereby the hypodermic needle-tipped syringe can be inserted and removed from the rubber stopper into a test tube positioned at said access position;

wherein said holder comprises a carousel having a plurality of radially extending channels adapted to receive test tubes, a top, having an access opening being radially extended and being provided in said top, means to move said top relative to said channels to position said access opening above any one of said channels.

11. A holder in combination with evacuated test tubes, said test tubes adapted to receive blood and bodily fluids transferred from a hypodermic needle-tipped syringe wherein said tubes include a test tube portion and a rubber stopper;

said holder having a plurality of channels extending from a front portion to a back portion of said holder and first and second edges alongside said channel, said edges spaced apart to permit said test tubes to slide within the channels;

means to move said test tubes in said channels from the back of the holder to a forwardmost position of said channels at the front portion;

a flap covering said forwardmost position of said holder, said flap having at least one hole, aligned directly above the rubber stopper of the forwardmost test tube in said channel;

said holder further having a top wall wherein said top wall and said flap combine to cover all of said test tubes in said holder;

means to remove said forwardmost test tube from said holder without opening said top wall;

whereby the hypodermic needle-tipped syringe can be inserted and removed from the rubber stopper through said hole directly into a test tube positioned at said forwardmost position, whereby the flap holds the tube in place while the needle is removed.

* * * * *